US008002243B2

(12) United States Patent
Murphy et al.

(10) Patent No.: US 8,002,243 B2
(45) Date of Patent: Aug. 23, 2011

(54) CONFIGURABLE WINCH

(75) Inventors: Michael S. Murphy, Baldwinsville, NY (US); Donald P. Ardine, Baldwinsville, NY (US); Stephen J. Kochan, Skaneateles, NY (US)

(73) Assignee: J.R. Clancy, Inc., Syracuse, NY (US)

( * ) Notice: Subject to any disclaimer, the term of this patent is extended or adjusted under 35 U.S.C. 154(b) by 164 days.

(21) Appl. No.: 12/267,968

(22) Filed: Nov. 10, 2008

(65) Prior Publication Data

US 2009/0212269 A1 Aug. 27, 2009

Related U.S. Application Data

(60) Provisional application No. 60/986,708, filed on Nov. 9, 2007.

(51) Int. Cl.
*B66D 1/26* (2006.01)

(52) U.S. Cl. ..... 254/278; 472/78; 212/200; 212/98

(58) Field of Classification Search ..... 254/278, 254/389, 393–395; 472/77–79; 212/200, 212/83, 98; 403/387, 384, 385
See application file for complete search history.

(56) References Cited

U.S. PATENT DOCUMENTS

| | | | | |
|---|---|---|---|---|
| 1,166,544 | A | 1/1916 | Prescott | |
| 1,821,563 | A * | 9/1931 | Mitchell et al. | 254/295 |
| 2,609,170 | A | 3/1948 | Farrington et al. | |
| 2,877,974 | A * | 3/1959 | Estes | 248/228.3 |
| 3,580,010 | A * | 5/1971 | Fisher | 464/150 |
| 3,601,347 | A * | 8/1971 | Attwood et al. | 248/242 |
| 3,994,111 | A * | 11/1976 | Papayoti | 52/650.3 |
| 4,199,133 | A * | 4/1980 | Gagnon et al. | 472/78 |
| 4,310,145 | A * | 1/1982 | Wempe | 251/144 |
| 4,324,386 | A * | 4/1982 | Gagnon et al. | 254/288 |
| 4,606,527 | A * | 8/1986 | Ziller et al. | 254/336 |
| 5,048,995 | A * | 9/1991 | Beaulieu | 403/264 |
| 5,105,349 | A | 4/1992 | Falls et al. | |
| 5,105,598 | A * | 4/1992 | Wilcox | 248/354.5 |
| 5,414,967 | A * | 5/1995 | Cates et al. | 52/281 |
| 5,519,597 | A | 5/1996 | Tsai | |
| 5,556,195 | A | 9/1996 | Glebe | |
| 6,135,421 | A * | 10/2000 | Bartelme et al. | 254/268 |
| 6,494,642 | B1 * | 12/2002 | Daly | 405/36 |
| 6,520,485 | B1 | 2/2003 | Soot | |
| 6,634,622 | B1 | 10/2003 | Hoffend, Jr. | |
| 7,293,762 | B2 | 11/2007 | Hoffend, Jr. | |
| 7,484,715 | B2 * | 2/2009 | Hoffend, Jr. | 254/393 |
| 2007/0094994 | A1 * | 5/2007 | Singleton | 52/698 |
| 2007/0246695 | A1 * | 10/2007 | Hoffend, Jr. | 254/393 |
| 2008/0229699 | A1 * | 9/2008 | Nehls | 52/653.1 |
| 2009/0127527 | A1 * | 5/2009 | Hoffend, III | 254/338 |
| 2009/0242861 | A1 * | 10/2009 | Kochan et al. | 254/293 |
| 2009/0309081 | A1 * | 12/2009 | Kempf | 254/336 |
| 2010/0078613 | A1 * | 4/2010 | Payne | 256/24 |

* cited by examiner

*Primary Examiner* — Emmanuel M Marcelo
(74) *Attorney, Agent, or Firm* — George R. McGuire; David B. Woycechowsky; Bond Schoeneck & King

(57) ABSTRACT

A lift system having a modular backbone with two or more backbone sections being attached end to end to form the backbone. Also, a lift system with end to end modular attachment, using universal joints, between motor assembly(ies), shaft section(s), drum assembly(ies) and/or shaft end sections. Also, a lift assembly with a backbone having longitudinally adjustable lift component attachment hardware, such as an elongated slot with lips suitable for engaging a nut tooth.

11 Claims, 10 Drawing Sheets

CONFIGURABLE WINCH

RELATED APPLICATION

The present application claims priority to U.S. provisional patent application No. 60/986,708, filed on Nov. 9, 2007; all of the foregoing patent-related document(s) are hereby incorporated by reference herein in their respective entirety(ies).

BACKGROUND OF THE INVENTION

1. Field of the Invention

This disclosure generally relates to lifts, hoists and/or winches, more particularly to relatively low weigh capacity lifts, hoists and/or winches and/or even more particularly for lifts, hoists and/or winches for raising and lowering lighting equipment, especially in industrial environments.

2. Description of the Related Art

It is a common requirement for luminaries (see Definitions section) in industrial environments, theatrical venues and other large spaces, such as hotel and office atria and lobbies, arenas and gyms, convention centers, auditoriums and places of worship to be installed in positions and at elevations that make access difficult. For example, installation, focusing and regular maintenance are all somewhat problematical because the luminaire is installed high off the ground and must be accessed with the aid of with ladders, scaffolding, man lifts or other access equipment. The use of this access equipment can be impractical, physically demanding and/or unsafe. Additionally, such access equipment is bulky and needs to be stored, deployed, secured and removed for every use. This use of access equipment may also undesirably restrict use of the facility by blocking public spaces and/or thoroughfares.

One alternative approach to accessing luminaries is to provide the luminaire with a winch, hoist or other suspension system (see Definitions section) that allows the luminaire to be safely lowered to a point where access is more easily obtained.

Some conventional suspension systems are manually powered. For example U.S. Pat. No. 1,166,544 ("Prescott") discloses an apparatus for raising and lowering chandeliers by manually turning cranks of a hoist. This approach has potential drawbacks both because of the manual labor required and also because of the space required.

Some conventional suspension systems are motorized. These motorized suspension systems have potential advantages over manual suspension systems in that a lower degree of operator proximity is generally necessary and less room is generally required for the installation. Some examples of conventional motorized lift systems are disclosed in the following US patents: (i) U.S. Pat. No. 2,609,170 ("Farrington"); (ii) U.S. Pat. No. 5,105,349 ("Falls"); (iii) U.S. Pat. No. 5,519,597 ("Tsai"); (iv) U.S. Pat. No. 5,556,195; ("Glebe"); (v) U.S. Pat. No. 7,293,762 ("Hoffend 1"); (vi) U.S. Pat. No. 6,634,622 ("Hoffend 2"); and/or (vii) U.S. Pat. No. 6,520,485 ("Soot"). Most, if not all, conventional motorized lift systems require the installation of the suspension system above the luminaire and, in many cases, above the ceiling structure. Although it may be possible to install such systems when a new building is being constructed, it may be difficult or impossible to add them once a building is in service.

A further problem and significant expense arises when an installation has multiple luminaries. Conventionally, multiple luminaries require the installation of multiple suspension systems. Also, there may be a need to suspend other suspended equipment in addition luminaries, such as loudspeakers, video monitors or displays, video or security cameras, seasonal decorations and signage. A further concern is the ease of getting power to such luminaries. Some conventional suspension systems disclose means for distributing power to an attached luminaries However, generally speaking, these conventional means of distributing power are not flexible, cannot accommodate multiple luminaries and/or cannot accommodate suspended electrical equipment other than the suspended luminaire(s).

FIG. 20 shows prior art nut tooth fastener hardware 500 including secured member 502; strut member 504; nut tooth member 512 and helical spring 508. The strut member includes two lips 506. The helical spring biases the nut tooth up into engagement with the two lips so that the nut tooth and spring can slide along and be positionally adjusted in the longitudinal direction of the strut member (that is, a direction in and out of the page with respect to FIG. 20). Secured member includes a through hole 503. The nut tooth member includes a tapped hole 514. A bolt (not shown) is inserted through the through hole and threadably engaged with the tapped hole to secure the secured member to the strut member. The nut tooth fastening hardware does not require any precise longitudinal direction alignment of the secured with respect to the strut member because of the longitudinal direction adjustability allowed by the geometry of the two lips of the strut member and the slidable nut tooth member and associated spring.

Description Of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

The present invention recognizes that it is preferable to have a lift system built with mechanical hardware that is relatively easy to work with. For example, theatrical lift systems are not generally easy to work with because they often require welding and other techniques for reliably securing large, heavy objects to building structures. The present invention also recognizes that it is preferable to have a lift system that can be easily built to various overall lengths and/or various lengths between consecutive cables without being predesigned for a specific installation and/or without having its components parts specifically fabricated for a specific installation.

The present invention is directed to a suspension system that is modular (see Definitions section) in various respect(s), such as: (i) modular drive shaft; and/or (ii) modular backbone. Preferably, a modular drive shaft is constructed according to the present invention by attaching drive shaft sections to each other by universal joints. Preferably, a modular backbone is constructed according to the present invention by attaching modular sections of backbone of two adjacent backbone sections by one or more U-shaped brackets held in place with spring loaded nut teeth. Preferably, the modular backbone sections include nut teeth slots including lips located and shaped to engaging with mating grooves in the spring loaded nut teeth.

According to a further aspect of the present invention, the backbone of the lift includes longitudinally adjustable lift component attachment hardware (see DEFINITIONS section). The longitudinally adjustable lift attachment hardware preferably takes the form of an elongated slot shaped to allow lift components (for example a motor assembly, a drum end assembly, a shaft end assembly) to be secured to any point along the slot by clamping hardware that clamps in a direction substantially perpendicular to the longitudinal direction. Even more preferably, the elongated slot includes two lips shaped and located to be able to engage spring-loaded nut teeth. Various embodiments of the present invention may exhibit one or more of the following objects, features and/or advantages:

(1) lift system of improved structure;

(2) lift system of improved manufacturability;

(3) lift system flexible in its construction and/or application such that it can be used in many different situations;

(4) lift system easily configured in terms of its cabling, configuration, and/or fixing hardware;

(5) lift system capable of providing power to multiple luminaries;

(6) lift system capable of providing power to audio, video and other control cables for suspended devices such as loudspeakers, video monitors, cameras and/or other devices commonly suspended devices;

(7) can replace conventional access equipment for accessing elevated fixtures, such as ladders, man-lifts and the like;

(8) does not require manual labor and the high degree of operator proximity generally required by manual lift systems;

(9) does not require as much elevated hardware (for example, hardware located over the ceiling structure) as many conventional lift systems;

(10) can be employed in building with elevated fixtures that have already been constructed and are already in service;

(11) lift system that can be installed by an electrician;

(12) lift system that does not require welding;

(13) lift system that does not require custom design and/or custom fabricated components for each installation;

(14) lift system that does not require welding;

(15) lift system that can utilize Unistrut-type hardware (see DEFINITIONS section); and/or

(16) lift system where at least some of the lift system components are relatively easy to cut to length.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
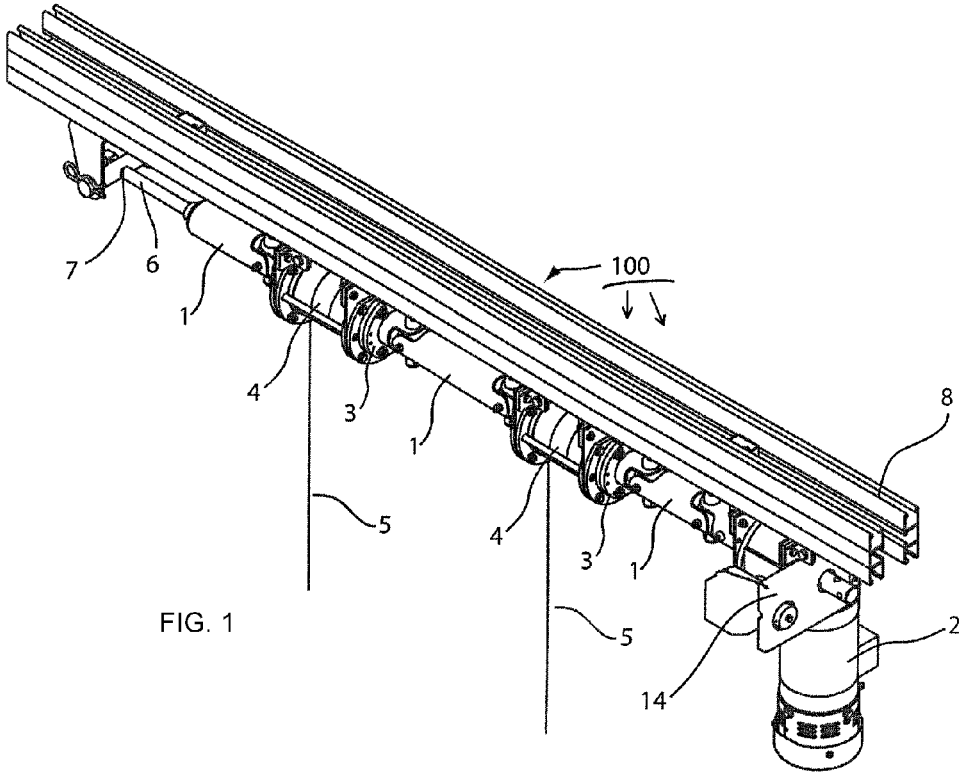
FIG. 1 is a perspective view of a first embodiment of a lift system according to the present invention.

FIGS. 1 to 4 are illustrations of an embodiment of the present disclosure showing a suspension system in the form of configurable winch 100 (sometimes also referred to as a lift system). The winch includes a backbone 8 on which are mounted the winch components. The backbone 8 is preferably constructed of an industry standard material such as "Unistrut" so that it may easily be attached to the building structure. Such material is well known in the art and has slots along the upper, lower and side surfaces such that a wide range of support attachments, fixings and hangers may be easily connected at any point so as to align with the building support structure. This system allows a single standard winch to be easily configured for mounting below, above, or to the side of any suitable structural element within the building without the need for custom manufacture. The configurable winch 100 may be mounted at any angle to existing structural steel or other support.

Motor 2 is attached to the backbone 8. Although the motor 2 is illustrated here as being mounted vertically below and perpendicular to the backbone 8 the disclosure is not so limited and the motor 2 may alternatively be mounted parallel to the backbone 8 and above, below, or to the side of the backbone 8. Although preferred embodiments of the present invention include a motor, some non-preferred embodiments may be manually operated. The motor 2 drives into a gearbox 14 which, in turn, powers a drive shaft 1. The gearbox 14 is illustrated here as a right-angle gearbox however any gearbox as commonly known in the art may be utilized, and some non-preferred embodiments may not include a gearbox at all. Motor 2 is preferably fitted with an integral or external safety brake.

Figure 3:
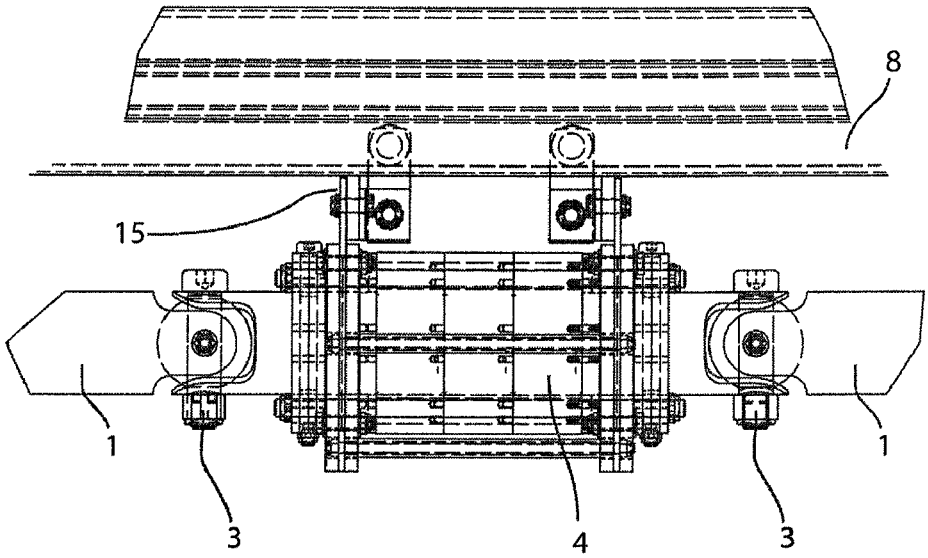
FIG. 3 is a side view, showing detail, of a portion of the first embodiment lift system.
Figure 4:
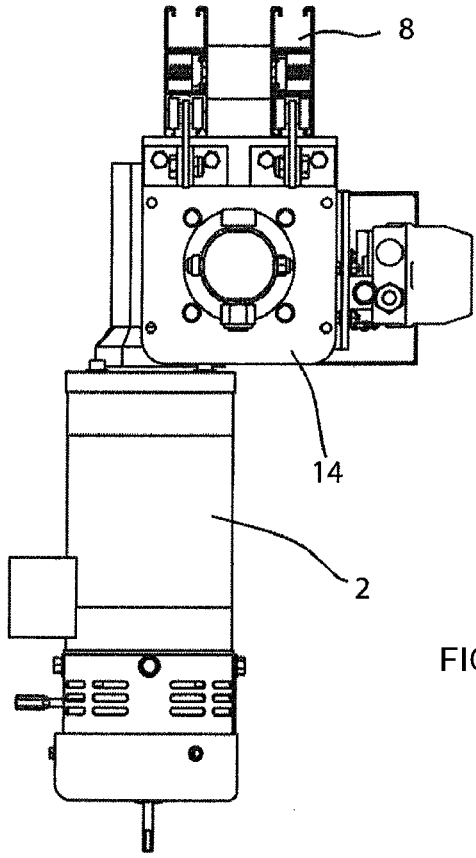
FIG. 4 is a side of a portion of the first embodiment lift system showing a motor.

Drive shaft 1 connects to a universal joint 3. Universal joint 3 provides flexibility in the alignment of the system. An existing building structure to which the assembly 100 is attached may not be perfectly straight and true and the universal joints 3 allow for any misalignment of the drive shaft from the cable drum 4 that such a structure may impose. Drive shaft 1, with or without universal joint 3, connects to a cable drum 4. As shown in FIG. 3, cable drum 4 is suspended from the backbone 8 through bearings and bearing supports 15. Cable drum 4 preferably has a helically grooved surface which, as the cable drum is driven to rotate by the drive shaft, will control and contain support cable 5 as it is spooled and unspooled on and off the cable drum. The support cables 5 may connect to a luminaire, a luminaire suspension bar, a luminaire suspension point and/or other suspended object(s).

The system 100 is constructed to be modular in several respects. Any number of modular drive shafts 1, modular universal joints 3 and/or modular cable drums 4 may be connected in any combination in a serial fashion in a single suspension system assembly. Any number of modular drive shafts 1, modular universal joints 3 and/or modular cable drums 4 may be connected in any combination in a serial fashion from a single motor 2 and gearbox 14. The lengths of the drive shafts 1 may be simply and individually selected or adjusted so as to provide any desired spacing between cable drums 4, and thus suspension cables 5, so as to accommodate any desired suspension spacing.

Figure 2:
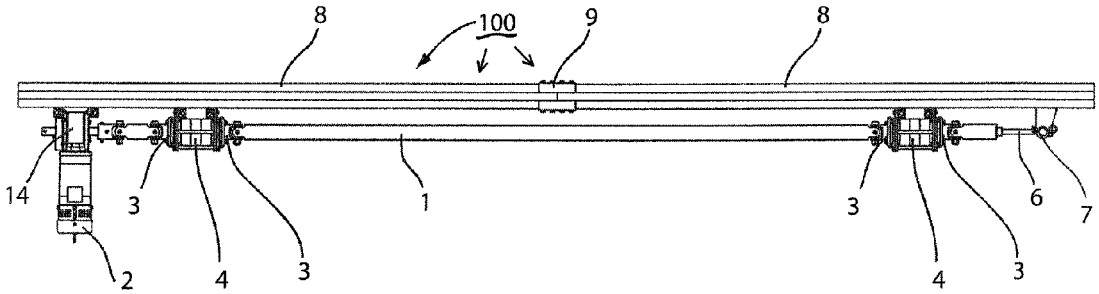
FIG. 2 is an elevation of the first embodiment lift system.

As mentioned above, and as shown in FIG. 3, there may be universal joints at some or all of the interfaces between portions of the modular drive shaft. For example, as illustrated in FIG. 2, each cable drum 4 may have a universal joint 3 on either side ensuring a restriction free drive for the motor drum 4 without the requirement for an accurately straight and flat mounting for the winch assembly 100. In this embodiment, this helpful adjustability in alignment of the drive shaft is imparted by universal joints. Alternatively, this adjustability may be imparted by any shaft alignment adjustability hardware now known or to be developed in the future. Drive shafts 1 may be solid drive shafts, hollow drive shafts or multi part extensible drive shafts connected by splines or other construction as known in the art to provide adjustable length. In other words, for a single modular drive shaft, some interfaces between drive shaft module portions may be adjustable in alignment (for example, universal joints (see Definitions section)), while other interfaces may be non-adjustable (for example, splines). It can be preferable to include both of these types of interfaces in a single modular drive shaft assembly so as to tailor the amount and location of adjustability, and to optimize the use of the more expensive and complex universal joint interfaces.

As the suspension cable 5 spools off the cable drum the point at which the cable leaves the cable drum will move along the axis of rotation of the cable drum thus moving the suspended luminaire along this same axis. In some installations this may not be desirable. To avoid this movement a further embodiment of the disclosure is fitted with a lead screw 6 at the end of the drive shafts 1. Lead screw 6 has a helical screw of the same pitch as the cable drums 4 and is threaded through a fixed threaded hole or nut 7 which is attached to the backbone 8. The entire assembly of cable drums 4, universal joints 3 and drive shafts 1 is free to translate in a direction parallel to its rotational axis. As the drive shaft rotates and the cable spool-off point moves the lead screw 6 will engage with threaded hole 7 such that the whole assembly will translate. The thread rotation directions and pitch are chosen such that the translation of the assembly is equal and opposite to the motion of the cable spool-off point thus effectively keeping this point stationary and ensuring that the support cable 5 remains in the same point. A sliding torque transmission system provides connection between the gearbox 14 and the first drive shaft 1. The sliding torque transmission system may comprise an externally splined drive shaft 1 sliding within an internally splined internal output gear of gearbox 14.

An alternative embodiment uses cable drums 4 with oppositely handed helical grooves. If two cable drums 4 are used to support a single load one drum 4 may have a clockwise or right-handed helical groove while the other drum 4 may have a counter clockwise or left-handed helical groove. As the support cables 5 spool on and off the two drums the two respective spool-off points will move the same distance towards or away from each other with the result that the angle that the support cables 5 make with the vertical will change but that the attached luminaries will move solely in a vertical plane.

Figure 5:
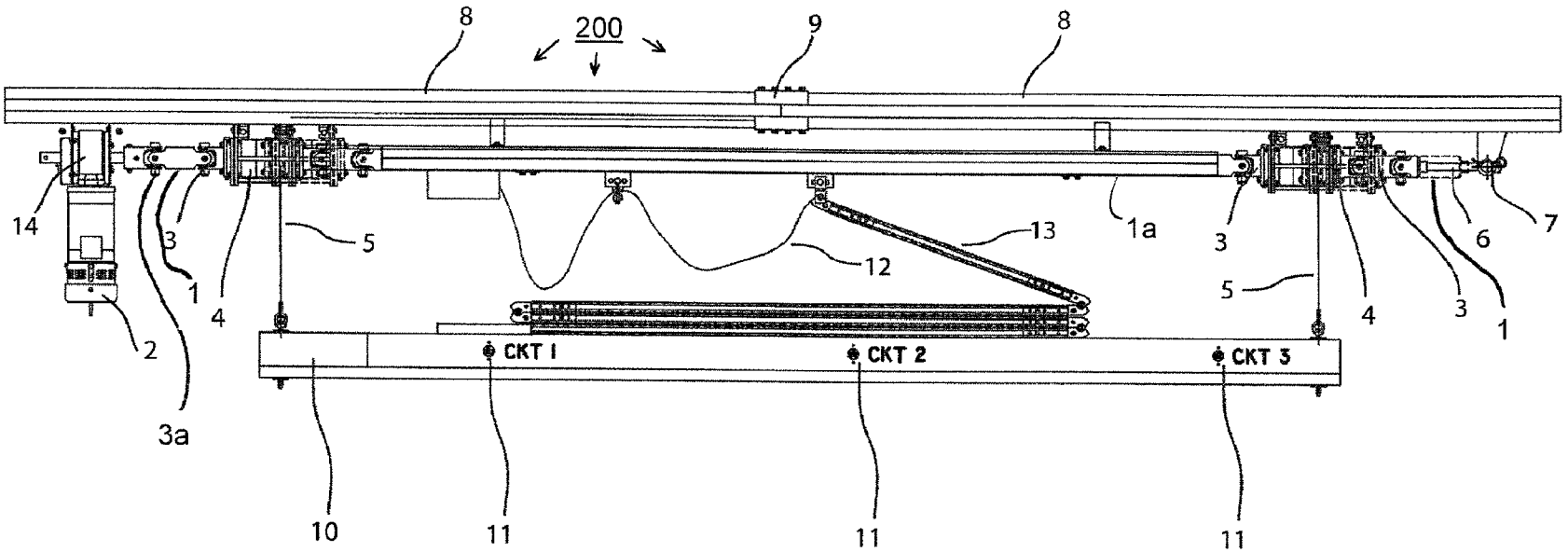
FIG. 5 is a side view of a portion of a second embodiment of a lift system according to the present invention including a cabling system.

FIG. 5 illustrates a second embodiment of suspension system 200 according to the present invention. Similarly to system 100, system 200 includes a backbone 8, motor 2, gearbox 14, drive shafts 1, universal joints 3 and cable drums 4. As shown by comparing FIG. 1 to FIG. 5, different lengths of drive shaft 1 may be combined to produce a desired separation of cable drums 4 and thus support cables 5. The backbone 8 may also be of modular construction. Multiple lengths of backbone 8 may be connected with mechanical connectors 9 to produce a total backbone of any length desired.

The modularity of the drive shaft and backbone of system 200 will now be discussed in further detail. Suspension system 200 is different than suspension system 100 in that it has: (i) a longer distance between drums 4; (ii) a longer run of drive shaft 1*a* between its drums; and (iii) an additional universal joint 3*a* in its drive shaft 1. Differences (i) and (ii) illustrate how the modular drive shafts and modular backbones according to the present invention can be helpful. More particularly, the longer run of drive shaft of system 200 was made by building a longer run of drive shaft from longer and/or more numerous modular drive shaft portions, connected at their mutual interfaces by splines, universal joints and/or other shaft joints. Also, the longer backbone of system 200 was made by building a longer run of backbone 8 using longer and/or more numerous modular backbone portions, connected in appropriate manner. Because the drive shaft and backbone are modular, many components of system 200 are common to system 100.

This modularity is advantageous at the manufacture and inventory level because it is easier to make and stock greater volumes of common parts, rather than having a unique whole-system design for each size system that users will want to use. This is advantageous at the user level because it allows the users greater flexibility. For example, if a customer had used system 100 in a previous application, but subsequently had need of a suspension system sized according to system 200, then the customer would simply need to obtain longer and/or additional drive shaft portions (and additional universal joint 3*a*), rather than obtaining an entirely new system. For users who make repeated use of their suspension systems for many different applications over time, this would clearly save much time and/or design effort, especially if the customer keeps extra modular backbone portions, extra modular drive shaft portions and/or extra universal joints around in anticipation of future needs. This is much more practical and cost effective for the user than purchasing a many suspension systems of various sizes.

Moving now to a discussion of the adjustable suspension operation of system 200, support cables 5 are connected to a luminaire support bar 10 to which the luminaries (not shown), or other suspended objects, may be permanently or removably attached. Luminaire support bar 10 may contain output sockets 11 which provide power for the luminaries. Multiple circuits (here shown as CKT1, CKT2 and CKT3) of any number and type may be provided. The supply cables 12 to supply output sockets 11 may be led down a system of folding trays 13. Such trays 13 serve to protect the supply cables 12 from damage, to constrain their movement, and to tidily maintain a continuous connection for electrical power. Folding trays 13 fold up and unfold in a 'Z' fold as luminaire support bar 10 is raised and lowered. Other embodiments may use further methods for handling the supply cables 12, including but not restricted to, cable spooling drums, helical cable forms and other cable handling mechanisms now known or to be developed in the future. In yet further embodiments, other cables such as video, sound and control cables may also be led through a cable management system down to a luminaire or luminaire support bar.

Figure 6:
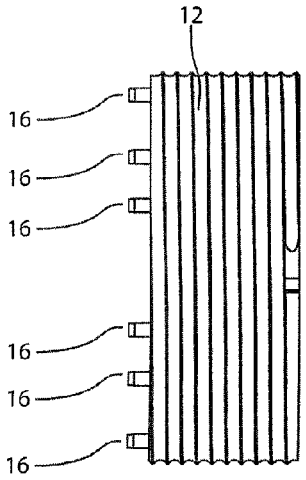
FIGS. 6-9 are orthographic views of the drum used in the first and second embodiment lift systems.
Figure 7:
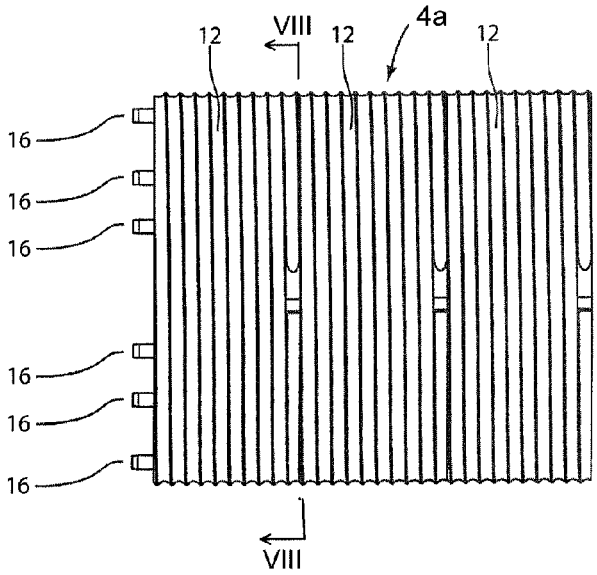
Figure 8:
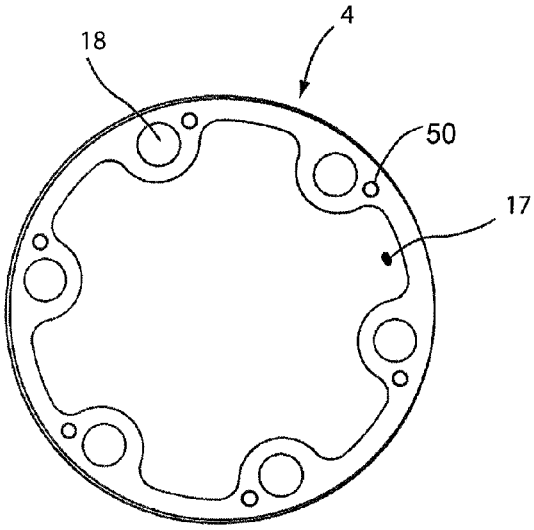

FIGS. 6 and 7 illustrate an embodiment of cable drum 4*a* suitable for use with system 100, system 200 and other suspension system embodiments according to the present invention. The cable drum 4 as shown in FIGS. 1 to 4 may be a single, unitary drum, but is preferably made from multiple modular sections 12 joined together as drum 4*a* shown in FIG. 7. The sections 12 are stacked along the axial direction of the drum in an appropriate number of sections having the appropriate length(s) so as to form a single drum as shown in FIG. 7. Each drum section 12 includes alignment pins 16 which engage with respective holes on the adjacent drum section 12. Preferably pins 16 and associated holes may provide alignment only and not torque transfer. Alternatively, other alignment hardware of alternative geometries could be provided, or alignment hardware could be omitted. FIG. 8 shows internal recesses 17 on the cable drum 4 which engage with mating protrusions on a central shaft (not shown) to provide drive torque to all drum sections 12 simultaneously. Preferably, bolts or other locking pins may pass through holes 18 in each section 12 of cable drum 4 to lock the cable drum together. The angularly-aligned sections 12 have their outer surfaces shaped such that the individual helical grooves align to form a single helical groove running across all sections 12 of the cable drum 4.

Figure 9:
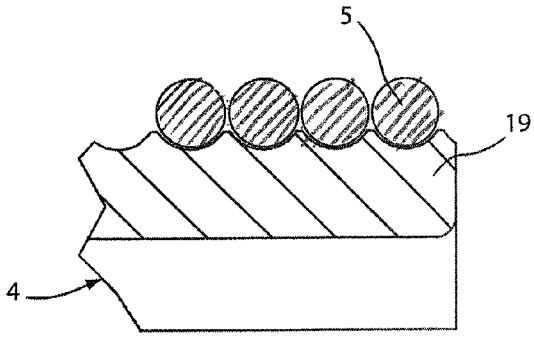

FIG. 9 shows a partial cross section with a section taken through a cable 5 wound around drum 4 to illustrate how a helical groove 19 in the surface of cable drum 4 may carry and guide the support cable 5. Cable 5 may be formed in modular sections connected in series along interfaces generally transverse to the central axis of the cable, but this modular construction for the cable is not necessarily preferred.

Figure 10:
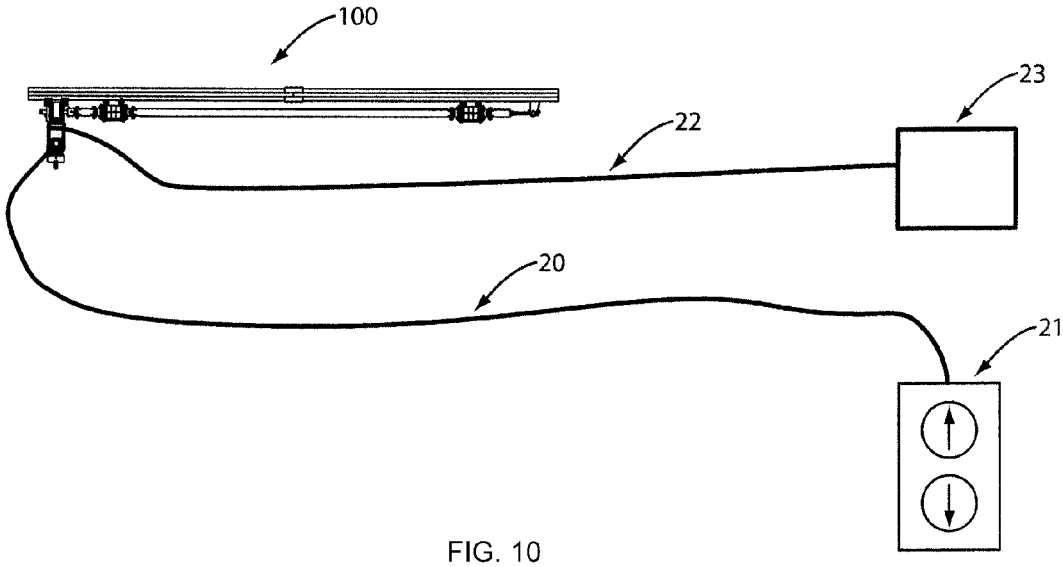
FIG. 10 is a schematic view of the first embodiment lift system, including its electronics.

FIG. 10 is a further illustration of system 100 within the context of an overall system schematic. Configurable winch 100 is connected to a control panel 21 through a control cable or cables 20. Control cable 20 may contain conductors carrying low voltage signals to the configurable winch 100. Control panel 21 may be sited at a remote location and may be fitted with push buttons, key switches or other control elements as well known in the art. Power is supplied to the configurable winch from power distribution point 23 though power cables 22.

Figure 11:
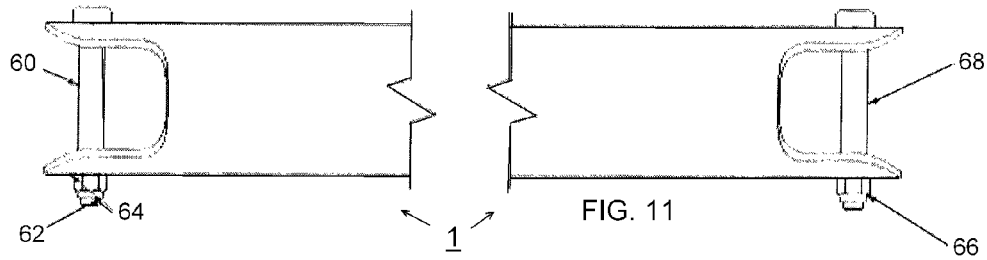
FIG. 11 is a side view of a modular shaft suitable for use in various embodiments of the present invention.
Figure 12:
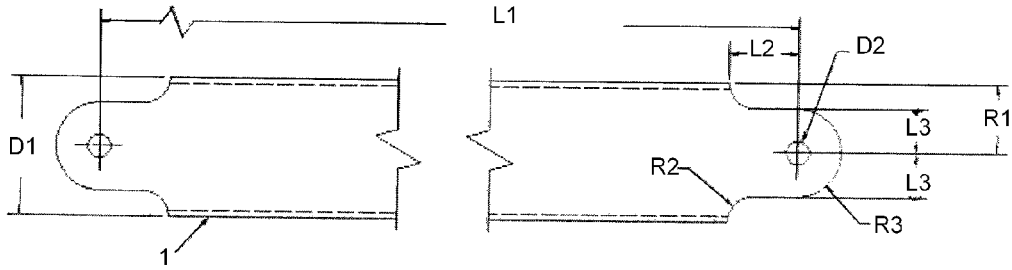
FIG. 12 is a top view of a modular shaft suitable for use in various embodiments of the present invention.

FIGS. 11 and 12 show modular shaft section 1 and certain attachment hardware suitable for making modular shafts for lift systems according to the present invention. As shown in FIG. 11, the preferred attachment hardware in includes: ½ X3 socket head shoulder bolts 60, 68; ⅜-16 UNC standard nylock nuts 62, 66; and end flange portion 64. The modular shaft section 1 is preferably made of lineshaft, such as 3" outer diameter X ⅛: wall steel mech tube.

As shown in FIG. 12, some exemplary dimensions for modular shaft section are as follows: (i) L1 will vary depending upon specific application; (ii) L2=1.50"; (iii) L3=0.94"; (iv) R1=1.50"; (v) R2=0.56"; and (vi) R3=0.94".

Figure 13:
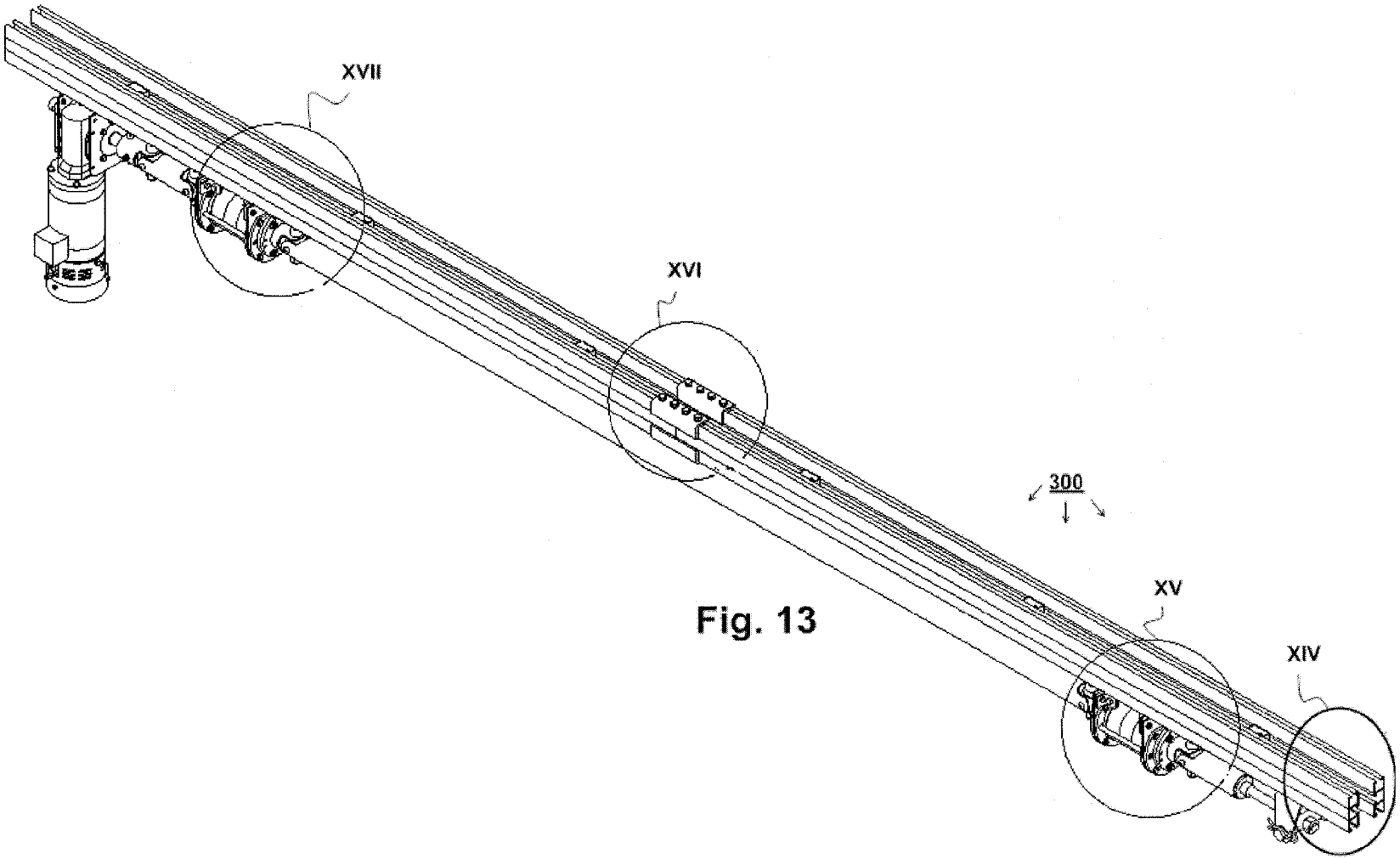
FIG. 13 is a perspective view of a third embodiment lift system according to the present invention.

FIG. 13 shows lift system 300, which includes several aspects of the present invention, including: a connection between two modular backbone sections; (ii) a universal joint connection between a shaft and a drum assembly that is driven to rotate by the shaft through the universal joint connection; (iii) a universal joint connection between a shaft and a motor assembly drives the shaft to rotate through the universal joint connection; and (iv) a backbone with longitudinally adjustable lift component attachment hardware (see DEFINITIONS section). It is noted that lift system 300 does not include the following aspect of the present invention: modular shaft (this aspect of the present invention will be discussed below in connection with FIG. 19).

In some preferred embodiments of the present invention, lift system 300 is powered and structured to handle a maximum load capacity of 300 to 100 pounds. Although theatrical lift systems generally have high load capacities, load capacities in the 300 pound to 100 pond range: (i) will generally be sufficient for lighting application (for example, lighting in industrial and/or public spaces); and (ii) this lower load capacity can help allow the use of modular construction and/or longitudinally adjustable lift component attachment hardware on the lift backbone.

Figure 14:
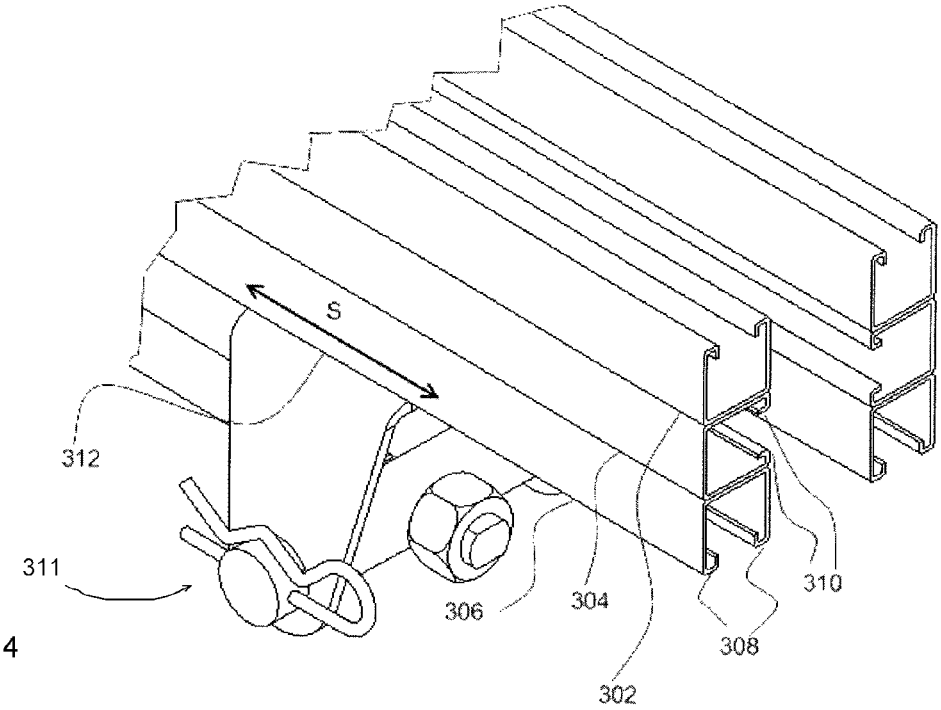
FIG. 14 is detail view of a portion of the view of FIG. 13.
Figure 20:
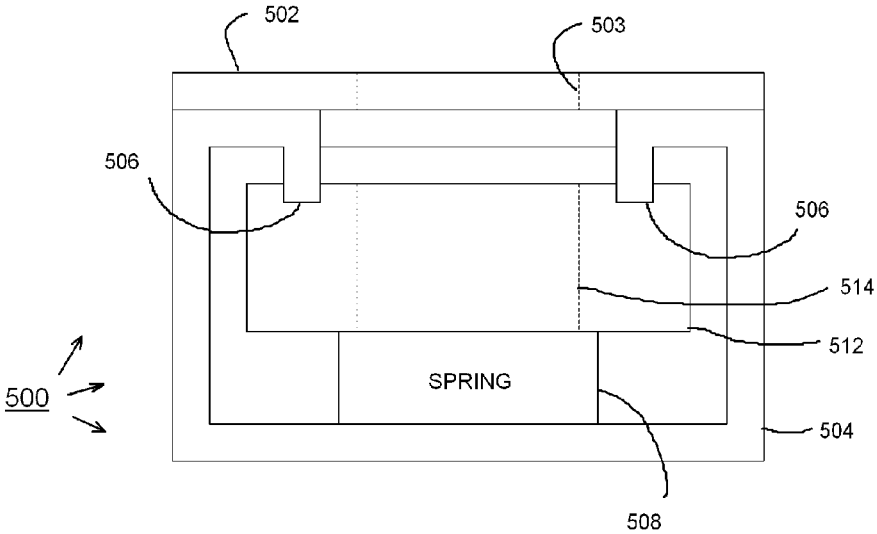
FIG. 20 (Prior Art)
FIG. 20 is a side view of a prior art nut tooth fastener which is utilized as longitudinally adjustable lift component attachment hardware (see DEFINITIONS section).

FIG. 14 is a detail view of the portion of lift system 300 where shaft end assembly 311 is connected to the backbone 302, 304, 308. As shown in FIG. 14, the backbone is made of Unistrut type hardware including: (i) two transversely spaced apart upper members 302; (ii) two transversely spaced apart middle members 304; and (iii) two transversely spaced apart lower members 306. The upper members 302 include upwardly facing slots with two lips, which can be used to help secure the lift system to ceiling beams or other structures of a building, as shown in FIG. 20. The middle members 304 include inwardly facing slots with two lips 310, which can be used to help secure the transversely spaced apart portions of the backbone to each other, as shown in FIG. 20. The lower members 306 include downwardly facing slots with two lips 308, which can be used to help secure the backbone to lift components, as shown in FIG. 20. These lift components attachable to the backbone using lips 308 include: a motor assembly (for example, a motor and gearbox); a drum assembly; and/or a shaft end assembly.

The downwardly facing slots with two lips 308 of lower members 302 are an example of longitudinally adjustable lift component attachment hardware according to the present invention because lift components can be attached to them in a longitudinally adjustable way. For example, shaft end assembly 311 is attached to the downwardly facing slots at interface 312. Preferably, the mechanical attachment at mechanical interface 312 is made by lips 308, bolts and spring loaded nut teeth (not shown). Because this connection is freely longitudinally adjustable (that is, adjustable in the direction of double arrow S), it doesn't matter exactly where the end of the shaft is located so long as the backbone extends at least a bit past that point.

In this way, the longitudinally adjustable lift component attachment hardware aspect of lift backbones according to the present invention can help minimize the need to specially design or specially fabricate lift components (such as a lift backbone) for a specific installation. Rather, the backbone members can be cut to length so that they are long enough, without the need to resort to precise and controlled dimensioning. More specifically, the backbone does not require any hardware for attaching lift components (such as through holes) to be designed and pre-fabricated at any specific longitudinal location on the backbone.

Figure 15:
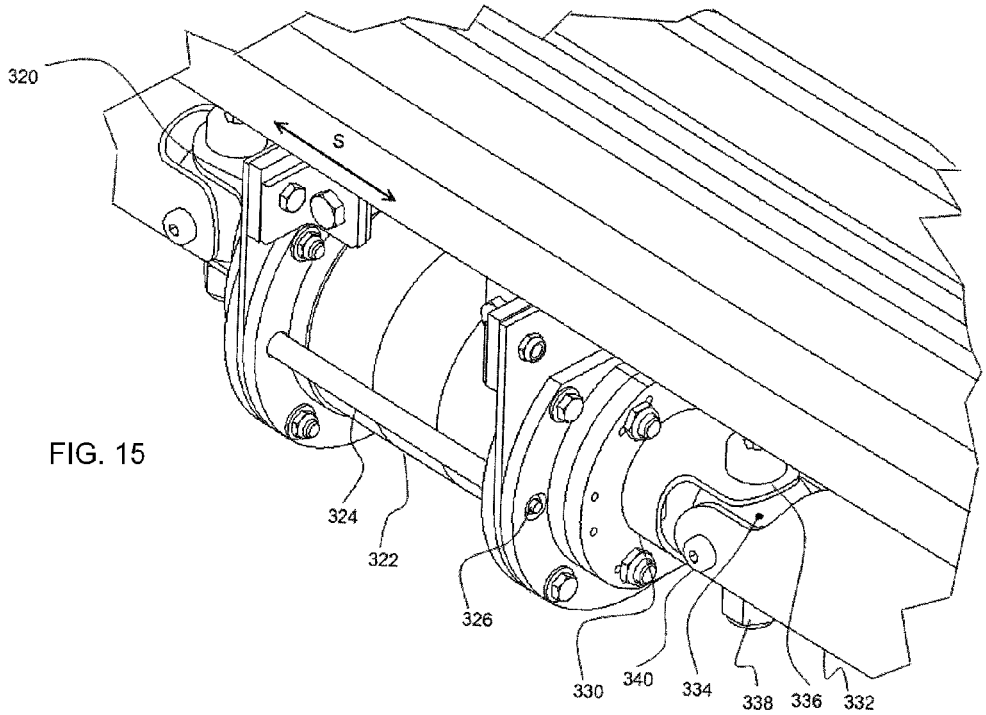
FIG. 15 is detail view of a portion of the view of FIG. 13.

FIG. 15 shows a detail view of a drum assembly suspended from a backbone, the drum assembly including: drum end plate sub-assembly 320; modular drum 322; cable keeper tube member 324; cable keeper threaded member and nut sub-assembly 326; drum/universal joint interface member 330; shaft/universal joint interface portion 332; universal joint member 334; first cross joint pin 336; locknut 338; and second cross joint pin 340.

The drum/universal joint interface member at each longitudinal end of the drum assembly allows a shaft to be attached at each end of the drum assembly, instead of having a shaft extend through the drum assembly itself. This makes the lift assembly more modular and means that less custom design and fabrication is required. Generally speaking, a shaft, driven to rotate by a motor, is attached by a universal joint (see DEFINITIONS section) at one end of the drum assembly to drive the drum to rotate and thereby effectuate the cable lifting and lowering operations of the lift. At the other end of the drum assembly, the other attached shaft (the spun shaft) is driven to rotate by the rotation of the drum. This means that further drum assembly(ies) can be installed and rotated at the other end of the spun shaft. Instead of being attached to a spinning shaft and a spun shaft at it ends, the drum assembly could be attached to a motor assembly and/or a shaft end assembly by a universal joint.

This use of universal joints at the ends of the drum assembly adds a lot of flexibility as to where drum assembly(ies) can be placed along the longitudinal length of a lift assembly according to the present invention. This cuts down on the degree of custom design and/or custom fabrication required, and can help allow the same lift components to be used for different lift assemblies over time.

Figure 17:
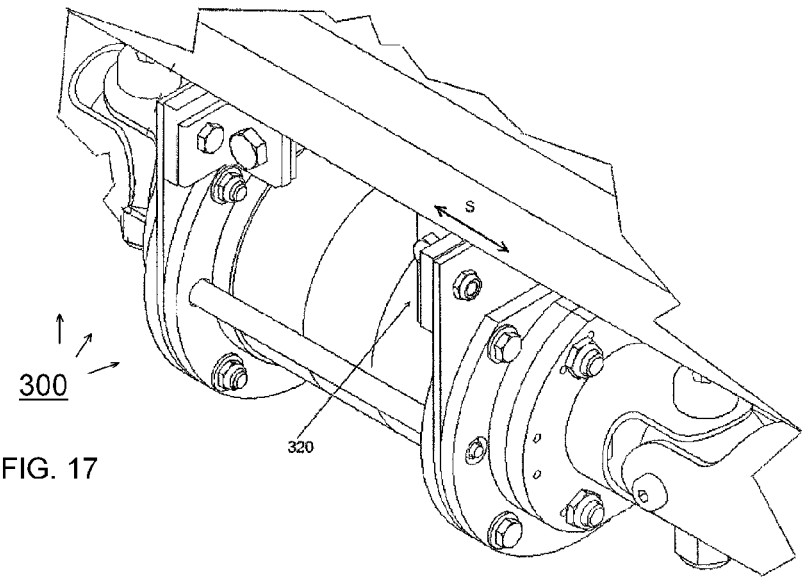
FIG. 17 is detail view of a portion of the view of FIG. 13.
Figure 18:
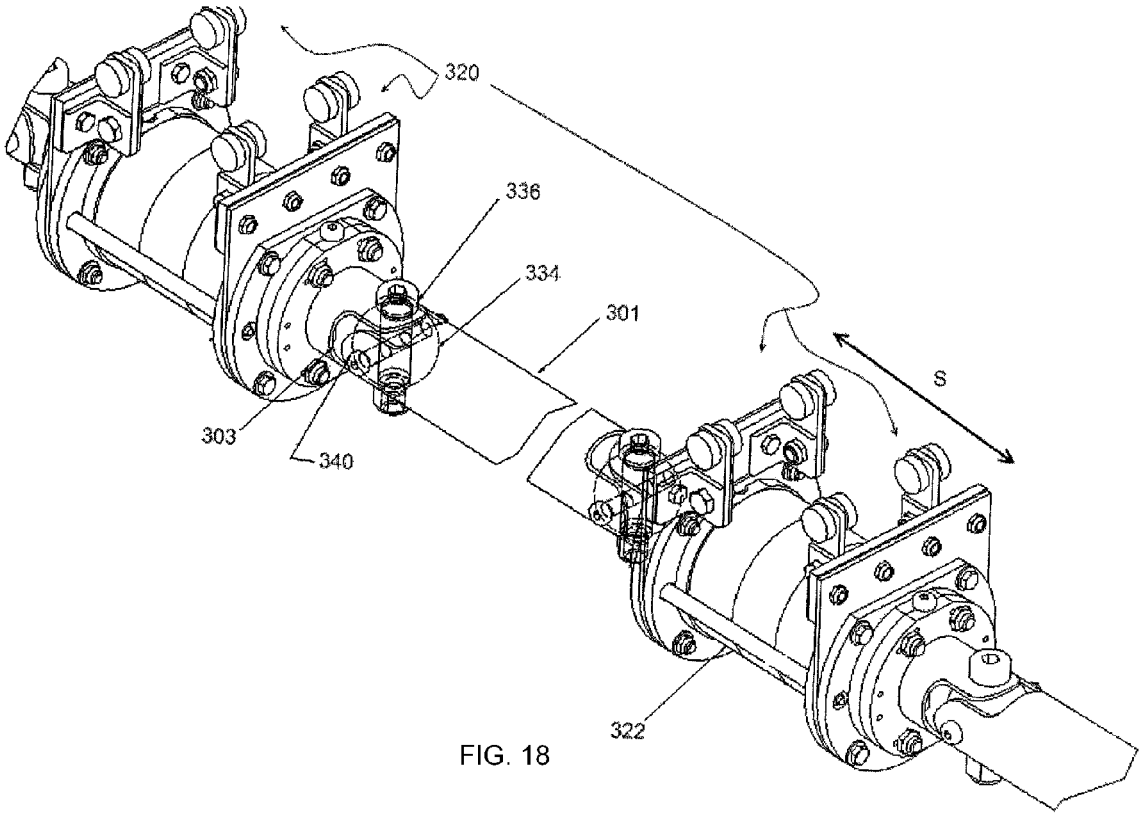
FIG. 18 is a perspective view of two drum assemblies of the third embodiment lift system.

As shown in FIGS. 15, 17 and 18, drum end plate assemblies 320 are supported by the backbone so that they are each longitudinally adjustable (that is, adjustable in the direction of double arrow S). Because the backbone includes longitudinally adjustable lift component attachment hardware (in this example, lips 308 as discussed in connection with FIG. 14), the longitudinal location of the drum end plate assembly, with respect to the backbone, does not need to be known in advance. This cuts down on the degree of custom design and/or custom fabrication required, and can help allow the same lift components to be used for different lift assemblies over time. FIG. 18 shows some preferred hardware for securing the drum plate end assemblies 320 to the backbone (not shown in FIG. 18). It is noted that the is hardware does not take the form of nut teeth and that it may even allow the drum plate assemblies to move in the longitudinal direction (that is along lips 308), while still supporting and securing them in the angular and radial directions.

As shown in FIGS. 15 and 17, drum end plate assemblies 320 are secured with respect to each other by cable keeper tube member 324 and cable keeper threaded member and nut sub-assembly 326. The tube member holds the drum end plate assemblies apart. A threaded member runs through both drum assemblies and through the tube and tightens each drum assembly down against its respective end of the tube member by being tightened into place by the nut of the cable keeper threaded member and nut sub-assembly 326. Besides holding together the opposing drum end plate assemblies 320 in the longitudinal direction, the cable keeper tube 324 and cable keeper threaded member and nut sub-assembly 326 prevent slack cable from getting too far away from the modular drum 322 and causing damage and/or worsening operational failure when a slack cable condition occurs. Preferably there are three cable keepers at spaced apart angular positions around the drum.

Figure 16:
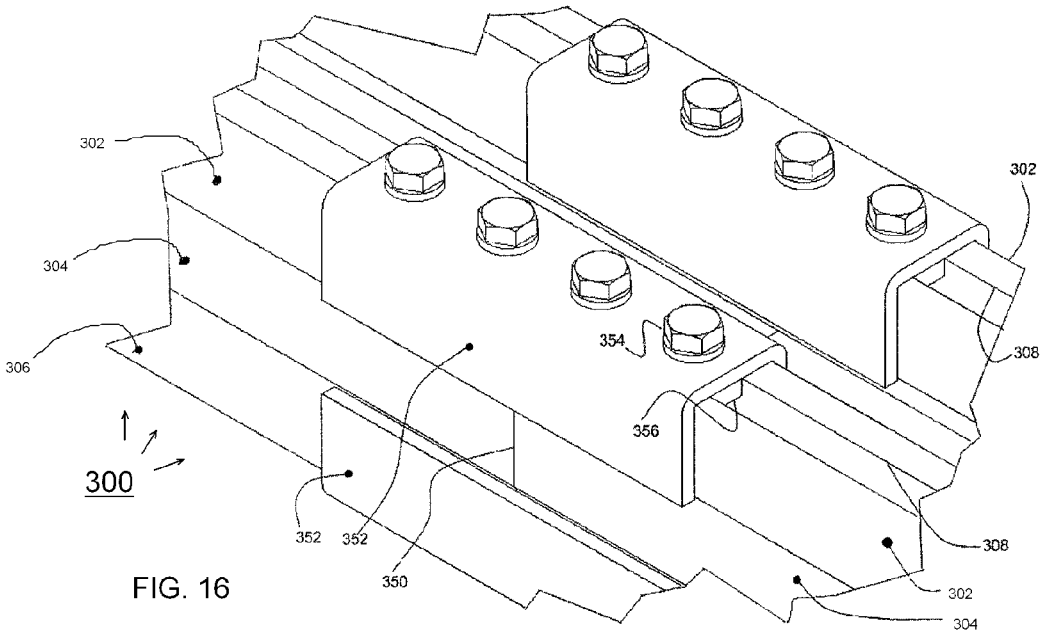
FIG. 16 is detail view of a portion of the view of FIG. 13.

FIG. 16 is a detail view of a splice between modular backbone sections. As discussed above in connection with FIG. 14, a modular backbone section in this embodiment of the present invention is made up of two upper members 302, two middle members 304 and two lower members. The backbone of lift system 300 is considered modular because one section 302, 304, 306 is joined end to end with another section 302, 304, 306 as shown in FIG. 16 at backbone interface 350. Although each modular backbone section has six members in this example, a modular backbone according to the present invention may: (i) have more or fewer members; and (ii) does not require that ever section have the same number of members (so long as each section has sufficient hardware for end to end modular attachment).

As shown in FIG. 16, the hardware for attaching modular backbone sections to each other is: four U-shaped brackets 352 (only three of the four are shown in FIG. 16); sixteen bolts 354 (only eight of these are shown in FIG. 16); and sixteen spring loaded nut teeth 356 (only two of these are partially shown in FIG. 16). It is noted that other attachment hardware could be used. For example, modular backbone sections could be fabricated with engaging flanges at their ends having holes for attachment bolts. Preferably the connection between modular backbone sections is attachable detachable, as is that connection made by the brackets, bolts and spring loaded nut teeth shown in FIG. 16.

FIG. 18 includes a good view of several universal joints that can be used according to the present invention for attaching end to end the following types of modular lift component sections to each other: shaft portions; drum end plate assemblies; shaft end assemblies; and/or motor assemblies. As shown in FIG. 18, a preferred type of universal joint according to the present invention includes drum/universal joint interface member 303; universal joint member 334; first cross joint pin 336; and second cross joint pin 340. Preferably: (i) the universal joint member is spherical, with two perpendicular through holes; (ii) the universal joint member has low friction characteristics; (iii) the universal joint member is made of plastic; (iv) the cross joint pins, and their respective through holes have different diameters; and/or (v) one through hole is 1 inch in diameter and the other through hole is ½ inch in diameter. Other types of universal joints are possible for use in the present invention, but the universal joint: (i) must provide secure attachment between consecutive end to end modular sections; and (ii) must provide at least reasonable co-axial alignment between the intended axes of rotation of consecutive modular end to end sections. Preferably, the end to end attachment is detachably attachable, as is the connection provided by the type of universal joint shown in FIG. 18.

Figure 19:
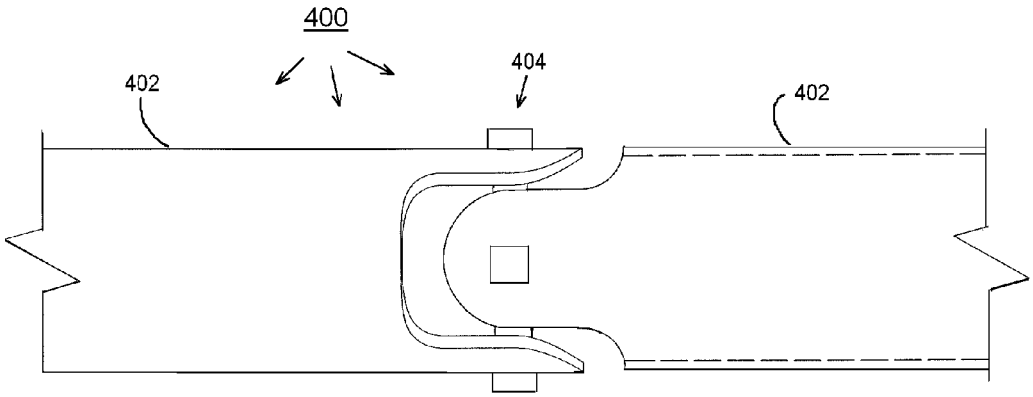
FIG. 19 is a side view of a portion of a modular shaft for a lift system according to the present invention.

FIG. 19 shows a shaft 400 where two modular shaft portions 402 are connected end to end by universal joint 404. the universal joint allows one shaft portion to drive the other shaft portion into substantially co-axial rotation. The use of the universal joint helps diminish the need for custom design and/or custom prefabrication of shafts. If an application requires a longer run of shaft (for example, a relatively long run of shaft between two drum section, or between a motor assembly and a drum section), then modular shaft sections can be connected end to end to build up the longer run of shaft.

This disclosure is not restricted to the particular embodiments disclosed. The cable drums are not restricted to the helical groove type shown, these drums are shown for illustrative purposes only and other types, orientations, and configurations of cable drums are covered by this disclosure. It is also to be understood that there is no limitation or requirement for the configurable winch to be used in only a horizontal position, the angles are used for illustrative purposes only and other angles for the winch would be understood by one skilled in the art and are within the scope of the disclosure.

DEFINITIONS

The following definitions are provided to facilitate claim interpretation and claim construction:

Present invention: means at least some embodiments of the present invention; references to various feature(s) of the "present invention" throughout this document do not mean that all claimed embodiments or methods include the referenced feature(s). First, second, third, etc. ("ordinals"): Unless otherwise noted, ordinals only serve to distinguish or identify (e.g., various members of a group); the mere use of ordinals implies neither a consecutive numerical limit nor a serial limitation.

Mechanically Connected: means either directly mechanically connected, or indirectly mechanically connected, such that intervening elements are present; the mechanical connection at least partially constrains relative motion between the mechanically connected elements, but it does not necessarily eliminate all relative motion between the elements (or portions thereof).

Luminaire: any electric lighting fixture, without regard to: (i) the type of lamps; (ii) the luminous flux of the lighting fixture; (iii) the presence or absence of reflectors; and/or (iv) the intended purpose of the lighting fixture.

Suspension system or lift system: winch, hoist or other suspension system, without regard to: (i) the type of object suspended, and (ii) whether the suspension system includes a means for distributing electrical power to the suspended object(s).

Modular: two components connected end to end with respect to their direction of elongation and/or rotational axis; modular components connected in a modular fashion do not necessary need to be similar components, or of equal length.

Universal joint: Any joint for connecting a first component having a first rotational axis to a second component having a second rotational axis so that rotational forces can be transmitted through the joint such that rotation of one component about its rotational axis will drive the other component to rotate about its rotational axis; generally (but not necessarily) universal joints include at least one hinge, in a rigid rod that allows the rod to 'bend' in at least one direction relative to its central axis; preferably, a universal joint will include a pair of ordinary hinges located close together, but oriented at 90° relative to each other that allow the rod to bend in any arbitrary direction relative to its central axis; universal joints include, but are not limited to, U joints, Cardan joints, Hardy-Spicer joints, and/or Hooke's joints.

Longitudinally adjustable lift component hardware: any hardware that allows attachment of lift components, such as motor assemblies, shaft end assemblies and drum end plate assemblies in a longitudinally adjustable fashion.

unistrut-type hardware: hardware of the type made by the Unistrut Corporation (www.unistrut.com), unistrut-type hardware is not limited to hardware actually made by the Unistrut Corporation; it is noted that the Unistrut name may be subject to trademark rights in various jurisdictions throughout the world.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. A lift system comprising:
a backbone;
a motor assembly;
a drive shaft; and
a first drum section;
wherein:
the motor assembly includes a universal joint connector and backbone connector hardware;
the backbone connection hardware mechanically connects the motor assembly to the backbone;
the drive shaft includes a first universal joint connector and a second universal joint connector;
the first universal joint connector of the drive shaft is directly mechanically connected to the universal joint connector of the motor assembly so that rotation of the universal joint connector of the motor assembly will drive rotation of the drive shaft about an at least substantially common axis of rotation;
the first drum section includes a first universal joint connector and a drum surface;
the drum surface of the first drum section is sized, shaped, structured and/or located to wind and unwind a cable therefrom; and
the second universal joint connector of the drive shaft is directly mechanically connected to the first universal joint connector of the first drum section so that rotation of the drive shaft will drive rotation of the first drum section about an at least substantially common axis of rotation.

2. The system of claim 1 wherein:
the backbone includes a first elongated member, a second elongated member and connection hardware;
the first elongated member defines a direction of elongation and includes a first end;
the second elongated member defines a direction of elongation and includes a first end;
the connection hardware mechanically connects the first end of the first elongated member to the first end of the second elongated member so that the direction of elongation of the first elongated member is:
at least substantially aligned with the direction of elongation of the second elongated member, and
at least substantially parallel with the substantially common axis of rotation of the universal joint connector of the motor assembly, the drive shaft and the first drum section.

3. The system of claim 1 wherein:
the backbone includes a first elongated member, a second elongated member and connection hardware;

the first elongated member defines a direction of elongation and includes a first end;

the second elongated member defines a direction of elongation and includes a first end;

the connection hardware mechanically connects the first end of the first elongated member to the first end of the second elongated member so that the direction of elongation of the first elongated member is:

at least substantially aligned with the direction of elongation of the second elongated member, and at least substantially parallel with the substantially common axis of rotation of the universal joint connector of the motor assembly, the drive shaft and the first drum section.

4. A lift system comprising:

a backbone;

a motor assembly;

a first drum section;

an intermediate shaft; and a second drum section;

wherein:

the motor assembly includes backbone connector hardware;

the backbone connection hardware mechanically connects the motor assembly to the backbone;

the first drum section includes a first universal joint connector and a drum surface;

the drum surface of the first drum section is sized, shaped, structured and/or located to wind and unwind a cable therefrom;

the motor assembly is operatively connected to the first drum section so that the motor assembly can drive the first drum section to rotate;

the intermediate shaft includes a first universal joint connector and a second universal joint connector;

the first universal joint connector of the first drum section is directly mechanically connected to the first universal joint connector of the intermediate shaft so that rotation of the first universal joint connector of the first drum section will drive rotation of the intermediate shaft about an at least substantially common axis of rotation;

the second drum section includes a first universal joint connector and a drum surface;

the drum surface of the second drum section is sized, shaped, structured and/or located to wind and unwind a cable therefrom; and the first universal joint connector of the second drum section is directly mechanically connected to the second universal joint connector of the intermediate shaft so that rotation of the intermediate shaft will drive rotation of the second drum section about an at least substantially common axis of rotation.

5. The lift system of claim 4 further comprising a drive shaft, wherein:

the motor assembly further includes a universal joint connector;

the drive shaft includes a first universal joint connector and a second universal joint connector;

the first universal joint connector of the drive shaft is directly mechanically connected to the universal joint connector of the motor assembly so that rotation of the universal joint connector of the motor assembly will drive rotation of the drive shaft about the at least substantially common axis of rotation;

the first drum section further includes a second universal joint connector; and the second universal joint connector of the drive shaft is directly mechanically connected to the second universal joint connector of the first drum section so that rotation of the drive shaft will drive rotation of the first drum section about the at least substantially common axis of rotation.

6. The system of claim 5 wherein:

the backbone includes a first elongated member, a second elongated member and connection hardware;

the first elongated member defines a direction of elongation and includes a first end;

the second elongated member defines a direction of elongation and includes a first end;

the connection hardware mechanically connects the first end of the first elongated member to the first end of the second elongated member so that the direction of elongation of the first elongated member is:

at least substantially aligned with the direction of elongation of the second elongated member, and at least substantially parallel with the substantially common axis of rotation of the universal joint connector of the motor assembly, the drive shaft and the first drum section.

7. A lift system comprising:

an elongated backbone defining a direction of elongation;

a motor assembly;

a drive shaft;

a threaded bearing;

a threaded shaft section; and a set of intermediate rotating component(s) wherein:

the elongated backbone includes a first end and a second end;

the motor assembly includes a universal joint connector and backbone connector hardware;

the backbone connection hardware mechanically connects the motor assembly to the backbone in the vicinity of the first end so that motor assembly is free to translate along the direction of elongation of the elongated backbone;

the drive shaft includes a first universal joint connector and a second universal joint connector;

the first universal joint connector of the drive shaft is directly mechanically connected to the universal joint connector of the motor assembly so that rotation of the universal joint connector of the motor assembly will drive rotation of the drive shaft about an at least substantially common axis of rotation;

the threaded bearing is rigidly mechanically connected to the backbone in the vicinity of its second end;

the threaded shaft section includes bearing engagement threads and a universal joint connector;

the engagement threads are threadably engaged with the threaded bearing so that the threaded shaft section will be driven by the threaded engagement to translate relative to the threaded bearing and backbone when the threaded shaft section rotates relative to the threaded bearing; and.

the backbone, motor assembly, drive shaft, threaded bearing and threaded shaft section are all sized, shaped, located and/or structured so that an axis of rotation of the universal joint connector of the threaded shaft section is at least substantially the same as the substantially common axis of rotation of the motor assembly and the drive shaft, and the set of intermediate rotating components are connected between the universal joint connector of the threaded shaft section and the second universal joint connector of the drive shaft so that the set of intermediate component (s) will:

rotate about the substantially common axis with the drive shaft, drive the threaded shaft section to rotate with the drive shaft, and translate relative to the backbone with the threaded shaft section.

8. The system of claim 7 wherein:

the elongated backbone includes a first elongated member, a second elongated member and connection hardware;

the first elongated member defines a direction of elongation and includes a first end;

the second elongated member defines a direction of elongation and includes a first end;

the connection hardware mechanically connects the first end of the first elongated member to the first end of the second elongated member so that the direction of elongation of the first elongated member is:

at least substantially aligned with the direction of elongation of the second elongated member, and at least substantially parallel with the substantially common axis of rotation of the universal joint connector of the motor assembly, the drive shaft and the first drum section.

9. The system of claim 7 wherein the set of intermediate component(s) comprises a first drum shaft section.

10. The system of claim 9 wherein the set of intermediate component(s) further comprises a second drum shaft section.

11. The system of claim 10 wherein the set of intermediate component(s) further comprises an intermediate shaft section connected between the first and second drum shaft sections.

* * * * *